United States Patent [19]

Glaunes

[11] Patent Number: 4,889,364

[45] Date of Patent: Dec. 26, 1989

[54] SKI-CARRYING ELEMENT

[76] Inventor: Andre Glaunes, Moutas, 47350 Escassefort, France

[21] Appl. No.: 188,327

[22] Filed: May 4, 1988

[51] Int. Cl.[4] ..... A63C 11/02

[52] U.S. Cl. ..... 280/814; 294/147

[58] Field of Search ..... 280/814, 815; 16/112, 16/124, 115; 294/147

[56] References Cited

U.S. PATENT DOCUMENTS

| | | | |
|---|---|---|---|
| 634,296 | 10/1899 | Hart | 280/293 |
| 959,235 | 5/1910 | Lemieux | 16/112 |
| 1,074,133 | 9/1913 | Neustaedter | 16/124 |
| 1,495,548 | 5/1924 | Cline | 16/112 |
| 2,983,402 | 5/1961 | Gottsegen | 16/124 |
| 3,114,487 | 12/1963 | Miller | 280/814 |
| 3,224,790 | 12/1965 | Holstein | 16/115 |
| 3,892,343 | 7/1975 | Warner | 224/45 |
| 4,157,763 | 6/1979 | Betlejewski | 220/94 |
| 4,234,113 | 11/1980 | Nalvarian | 224/45 |
| 4,326,747 | 4/1982 | Finnegan | 294/147 |
| 4,427,217 | 1/1984 | Sauzay | 280/814 |

FOREIGN PATENT DOCUMENTS

| | | | |
|---|---|---|---|
| 2517215 | 6/1983 | France | 280/814 |
| 2601881 | 1/1988 | France | 280/814 |
| 26229 | 9/1915 | Norway | 280/814 |
| 8705819 | 10/1987 | World Int. Prop. O. | 280/814 |

*Primary Examiner*—David M. Mitchell

*Attorney, Agent, or Firm*—Armstrong, Nikaido Marmelstein Kubovcik & Murray

[57] ABSTRACT

A ski-carrying element that enables a ski to be carried by hand substantially horizontally, in a balanced fashion. The ski-carrying element has, on the one hand, a fixed part provided with means for fastening to the sole piece of the ski on the face having the ski boot bindings, and, on the other, a part used for gripping and adapted to move between an unfolded position, in which it goes beyond one of the sides of the sides of the ski when the ski-carrying element is being used, and a retracted position in said fixed part in the non-operative position of said ski-carrying element, including the operative position of the ski. The movable part is so mounted as to pivot about an axis perpendicular to the sole piece of the ski, and the fixed part has an abutment means against which the movable part bears in the operative position of the ski-carrying element, under the effect of the heavier weight of the part of the ski located behind said ski-carrying element relative to the axis of rotation.

6 Claims, 3 Drawing Sheets

SKI-CARRYING ELEMENT

FIELD OF THE INVENTION

The present invention relates to a ski-carrying element that enables a ski to be carried by hand in a balanced fashion by means of a movable gripping part that can be moved between a retractable position in a fixed part of the ski-carrying element, when the latter is not being used, and an unfolded position in which it goes beyond one side of the ski.

BACKGROUND OF THE INVENTION

It is common knowledge that carrying skis by hand, for example, when going to or returning from the slopes, is very inconvenient. Therefore, various devices have heretofore been devised for carrying skis on such occasions. Thus, European patent application No. 043 784 describes a ski-carrying element that enables a ski to be carried by means of a handle adapted thereto at the site of the bindings. The handle is movable between a retractable position and an unfolded position, as indicated above. Each handle is fastened permanently to the corresponding ski and can be retracted into a position below the site reserved for the boot. In one specific embodiment of this ski-carrying element of known construction, the latter has a fixed part in the form of a plate connected to the sole piece of the ski by any means. The actual handle has the shape of a U, the two arms of which slide into housings provided in the aforementioned plate and whose web constitutes the gripping part. Springs mounted around arms of the handle and located inside their housings return the handle to its retracted position.

This device has the drawback of requiring springs, which complicate assembly. Another drawback is that the gripping part of the handle goes laterally beyond the sole piece of the ski.

SUMMARY OF THE INVENTION

The present invention proposes a ski-carrying element of the above-mentioned type in which the moving part is mounted such as to be displaceable by pivoting, making it possible to retract it completely onto the sole piece of the ski in the non-operative position of the ski-carrying element. Also, the invention leads to a construction that simply uses flat molded pieces and, finally, it renders highly impervious constructions possible. Finally, because of the provision that the moving part rotates about a pin and an arresting device prevents the ski from rotating relative to the handle, the heaviest part of the ski being located behind the axis of rotation, excellent balance of the ski(s) is assured during transportation.

Therefore, the object of the invention is, first, a new industrial product made up of the ski-carrying element that enables a ski to be carried by hand substantially horizontally, in a balanced fashion. The ski-carrying element has, on the one hand, a fixed part provided with a device for fastening to the sole piece of the ski on the face having the ski boot bindings, and, on the other, a part used for gripping. The fixed part moves between an unfolded position, in which it goes beyond one of the sides of the ski when the ski-carrying element is being used, and a retracted position in the fixed part in the non-operative position of the ski-carrying element, including the operative position of the ski. The moving part is so mounted as to pivot about an axis perpendicular to the sole piece of the ski, and the fixed part has an abutment device against which bears the moving part in the operative position of the ski-carrying element, under the effect of the heavier weight of the part of the ski located behind the ski-carrying element relative to the axis of rotation.

Preferably, the fixed part has an abutment device against which bears the moving part in the non-operative position of the ski-carrying element, in which the moving part does not go beyond the sole piece of the ski.

The ski-carrying element may also include a device to return the moving part to its retracted, non-operative position.

According to one characteristic of the present invention, the fixed part has a plate mounted on the sole piece of the ski without going therebeyond and carries the abutment device for the moving part in the operative position of the ski-carrying element. The moving part consists, on the one hand, of an element binding it with the fixed part, including the pivoting device in addition to those carried by the latter and, on the other hand, an operating handle extending the binding. The aforesaid plate may be protected by a cover, and the space between plate and cover serves as a housing for binding of the moving part.

According to a first embodiment of the invention, the binding of the moving part is mounted simply to pivot about the axis of rotation located substantially in the center of the plate. In this case, the abutment device carried by the fixed part to cause the moving part to abut thereagainst in the operative position of the ski-carrying element may consist of the side wall of an excessively thick area of the plate, the upper face of which serves as a point of support for the cover, with the binding of the moving part bearing against the abutment device via an edging area.

More particularly, the excessively thick area may have a triangular shape and the binding of the moving part is capable of abutting against the oblique stop formed by the side wall of said area, in the operative as well as in the non-operative position of the ski-carrying element by either of two separate edging areas cut in accordance with the oblique stop. Alternatively, the plate may have a fixed stud and the binding of the moving part may have a slot in the shape of a circular arc centered on the axis of rotation. The stud forms the stop against which abuts the moving part by either of the terminal edges delimiting the slot in either the operative or non-operative position of said ski-carrying element.

According to a third embodiment, the binding element of the moving part is mounted such as to slide along the plate in a direction perpendicular to the midline of the sole piece of the ski, on one side thereof, between a position corresponding to the non-operative position of the ski-carrying element, where it is prevented from rotating, and an extended position in which it is capable of only pivoting about the axis of rotation located in the corresponding terminal area of the plate. The handle is connected to the binding on the opposite side of the area in which pivoting occurs.

In this case, the axis of rotation may be carried by the plate, and the binding may have a slot, which is traversed by the pin, in order to enable the binding to slide. Moreover, the stop carried by the fixed part, against which abuts the moving part in the operative position of the ski-carrying element, consists in this case of the sharp edge of a rim of the plate on which the cover can be mounted.

In accordance with another interesting characteristic of the invention, the handle has a first arm fixedly connected to the binding of the moving part, and a second end arm which is hinged to the first arm around an axis perpendicular to the plane of the handle, so that it can be folded back toward the first arm in the non-operative position of the ski-carrying element.

In this case, devices may be provided to return the second arm of the handle to the folded-back position in the direction of the first arm.

The present invention also has as its object a device that enables a pair of skis to be carried by hand, characterized by the fact that it has, for each ski, a ski-carrying element as described above.

This device may also include a retaining element adapted to bring the two skis in abutting engagement with each other when they are being carried, and/or a retaining element designed to bring the two movable gripping parts into abutting engagement with each other, also when the skis are being carried.

Whatever the variant of the device embodying the invention, it may advantageously be constructed as an element that is independent of the toe and heel bindings of the ski boot. The element is positioned on the ski independently of the bindings, but a provision may also be made that the device of the invention forms an element that is incorporated into the base plate of the toe binding of the boot.

A better understanding of the present invention will be obtained by describing, by way of purely illustrative non-limiting examples, three embodiments shown in the accompanying drawing.

Figure 1:
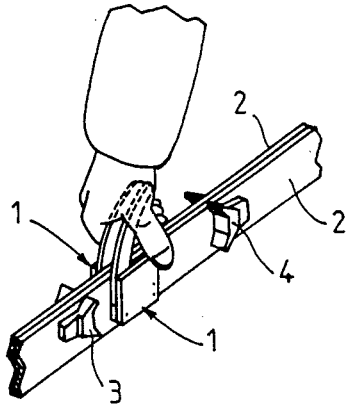
FIG. 1 is a partial schematic representation, in perspective, of a pair of skis designed for downhill skiing, carried in one hand by a person by means of the ski-carrying device made up of two ski-carrying elements in accordance with the first of the three embodiments described above.
Figure 2:
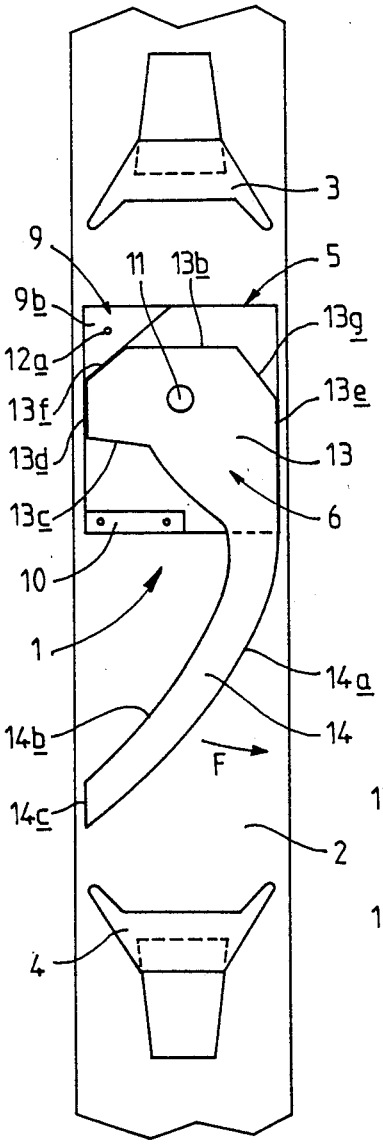
FIG. 2 is a partial top plan view of a ski resting on its sole piece, in which view are shown the two bindings between which is disposed the ski-carrying element in accordance with the first embodiment, the cover of the fixed part having been removed to show the structure of the plate of the fixed part, as well as the structure of the moving part, the ski-carrying element being in its retracted position corresponding to the operative positive of the ski.
Figure 3:
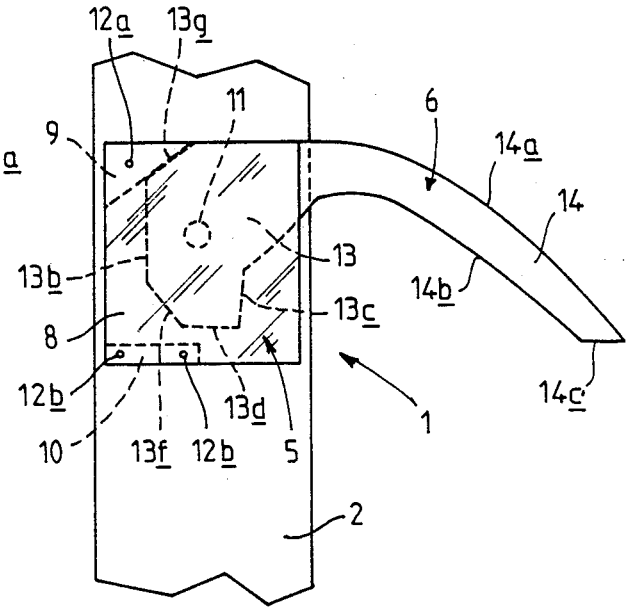
FIG. 3 is a view corresponding to FIG. 2 showing the whole ski-carrying element in its operative position.

Now, referring to FIGS. 1 through 4, reference numeral 1 generally designates the ski-carrying element in accordance with a first embodiment of the present invention, with which is provided a ski 2, in which there is shown in FIGS. 1 through 3 only the part having the bindings forming the toe binding 3 and heel binding 4. Ski 2 is a ski used for downhill skiing. It will be understood that ski-carrying element 1 may also be used on a ski designed for cross-country skiing, in which case there is no heel binding 4.

Ski-carrying element 1, which is mounted on the sole piece of ski 2, between the two bindings 3 and 4, is made up of a fixed part 5 and a moving part 6.

Figure 4:
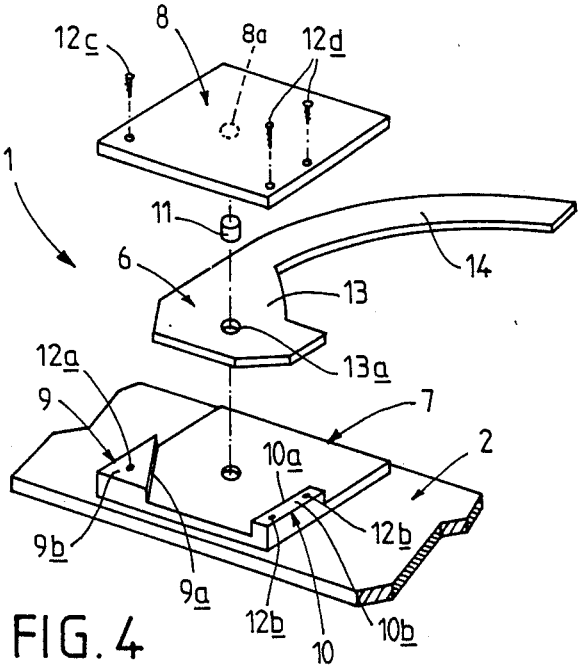
FIG. 4 is an exploded view, in perspective, of the ski-carrying element shown in the preceding Figures.

Fixed part 5 itself consists of two pieces 7 and 8, as can be seen in particular in FIG. 4, piece 7 forming a binding plate on the sole piece of the ski, and piece 8 is a cover which is pressed against and mounted on plate 7, with the moving part 6 being interposed therebetween.

Plate 7, molded from a relatively rigid plastic material, consists of a rectangular base plate 9, all points of which are pressed against ski 2, with its longitudinal edges parallel to those of ski 2 and having a width less than that of sole piece of ski 2 in the corresponding area.

The plate 7 has on one of its faces two excessively thick areas 9 and 10 disposed at two adjacent angles along one of the longitudinal edgings. Area 9 is triangular and area 10 has the form of a rectangle with its longitudinal inner face 10*a* turned toward the inner oblique face 9*a* of area 9 forming a right-angled shoulder with the main surface of plate 7. The upper faces, respectively, 9*b* and 10*b* of excessively thick areas 9 and 10 serve as points of support for cover 8 consisting of a rectangular plate of the same dimensions as plate 7 and advantageously made of the same material.

Also, cover 8 has a central opening 8*a* to enable the passage of a pin 11 carried by plate 7, in its center, on the same side as areas 9 and 10, the pin constituting the axis of rotation of moving part 6.

A hole 12*a* and two holes 12*b* for the passage of, respectively, one screw 12*c* and two screws 12*d* are provided, opposite each other, in cover 8, and areas 9 and 10 of plate 7 for the binding of part 5 onto ski 2.

Moving part 6 is a flat element, also molded from a relatively rigid plastic material, and it has a central binding part 13, ensuring the binding with fixed part 5 and extending laterally by means of a curved handle 14.

Binding part 13 is in abutting engagement with plate 7, and has a central opening 13*a* intended to register with opening 8*a* to enable pin 11 to pass therethrough. Binding part 13 may be defined as an elongated strip with a length substantially equal to the width of plate 7, having the aforesaid opening 13*a* and being delimited by two longitudinal edgings 13*b* and 13*c* and two side edgings 13*d* and 13*e*, and in which two corner cuts are made to form edgings 13*f* and 13*g*, which are connected to edging 13*b*. The inclination of edgings 13*f* and 13*g* relative to edging 13*b* is the same as that of face 9*a* relative to the transverse edging of plate 7.

Handle 14 is connected to edging 13*c* and is delimited therefrom by an external edge 14*a*, which extends edging 13*e* rectilinearly, then curves in such a way as to exhibit a concavity that curves toward part 13, and by an internal edge 14*b* substantially parallel to external edge 14*a*, except near its connection with edging 13*c*, where it takes an opposing concavity to form a wider junction area between the actual handle 14 and binding part 13. The two edgings 14*a* and 14*b* are joined on their free ends by a terminal edging 14*c* located in the alignment of edging 13*d*.

For assembly, plate 7 is pressed against the sole piece of ski 2 between bindings 3 and 4, so that the excessively thick area lies on the side of toe binding 3, and area 10 lies on the side of heel binding 4. Then, moving part 6 is pressed against plate 7, as a result of which opening 13*a* is traversed by pin 11, and handle 14 lies, for example, opposite binding 4, fully contained within the limits of the sole piece of ski 2, as shown in FIG. 2. In this position, edge 13*f*, at travel end, is in abutting engagement with face 9*a* of area 9, in its part closest to area 10, which is not long enough to interfere with the passage of handle 14. Cover 8 is then pressed thereagainst and screws 12*c* and 12*d* are tightened. Pin 11 may also serve as fastening point between cover 8 and plate 7.

The overall thickness of ski-carrying element 1, thusly installed on ski 2, is such that the element 1 is readily accommodated in the free space between the ski boot and ski 2.

When the skier wants to carry his skis by hand, the skier swivels handle 14 of each ski-carrying element 1, with which each of the skis is provided, in the only direction possible, which is indicated by arrow F (FIG. 2), and he grasps the two handles 14, as illustrated in FIG. 1. Since the rear part of each ski 2, determined from the axis of rotation 11, is heavier than its front part, ski 2, for transport, is, at travel end, with face 9*a* of fixed part 5 of ski-carrying element 1 in abutting engagement with edging 13*g* of moving part 6, thereby providing the assembly with good balance for transport.

Figure 7:
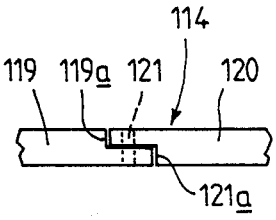
FIG. 7 is a side view taken along line VII—VII of FIG. 6.
Figure 5:
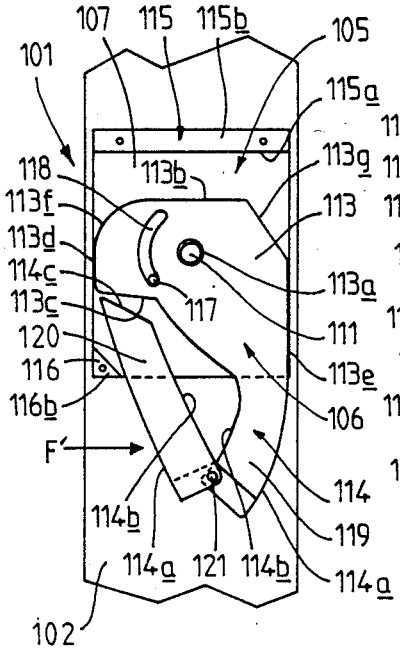
FIGS. 5 and 6 are views similar to FIGS. 2 and 3, respectively, and show a ski-carrying element in accordance with the second embodiment of the present invention mentioned earlier.
Figure 6:
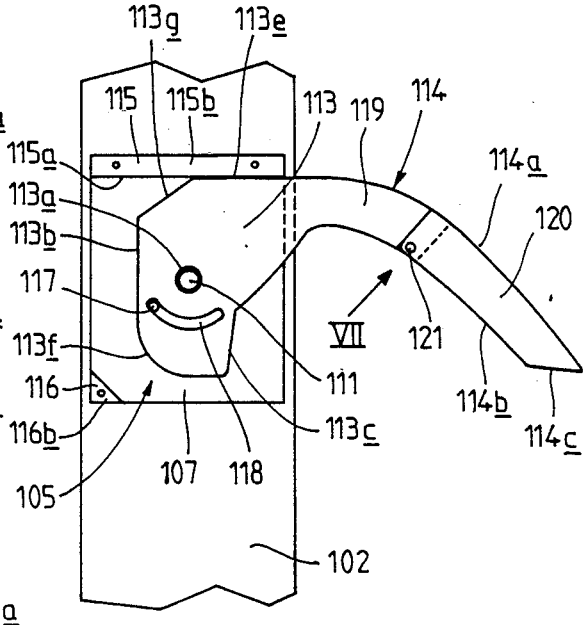

Now, referring to FIGS. 5 through 7, it will be seen that 101 generally designates a ski-carrying element in accordance with a second embodiment of the invention. As with the preceding embodiment, this element 101 has a fixed part 105 and a moving part 106. The fixed part 105 also consists of two parts, i.e., a plate 107 and a cover, which is not shown in the drawing, but which is made of a rectangular plate, like the cover 8 described above.

Plate 107, formed by a rectangular base plate and designed to be pressed in a longitudinal direction against the sole piece of ski 102. The plate 107 without going therebeyond, has along the totality of one of its transverse edgings, and on one side, an excessively thick area 115, forming a right-angled set-back 115*a*. Across therefrom, still on the same side, plate 107 has another excessively thick area 116, which is angularly disposed and has a triangular shape. The two upper surfaces 115*b* and 116*b* of excessively thick areas 115 and 116 serve as points of support for the cover and, in the same way as before, holes are provided opposite each other to enable the passage of set screws on the ski, which are not shown herein.

Furthermore, plate 107 has, located on its longitudinal mid-line, on the same side as excessively thick areas 115 and 116, a pin 11 which is perpendicular to the plane of the plate 107, relatively closer to the edge provided with excessively thick area 115. A short distance from pin 111 and on the opposite side in relation to excessively thick area 115 is stud 117 which is also perpendicular to the plane of plate 107.

Moving part 106 has substantially the same overall shape as part 6 of the first embodiment. Therefore, it will not be described in detail, since in FIGS. 5 and 6, in order to designate the same elements, reference numerals have been used which are 100 more than those used to describe part 6. One of the differences is that edging 113*f* is rounded, since here it does not act as a stop, as will be indicated hereinafter.

Furthermore, part 113 which, after assembly, rests on plate 107, has a central opening 113*a* adapted to receive pin 111, as well as a slot 118 in the form of a circular arc whose center is formed by the axis of opening 113*a* and extending between edges 113*b* and 113*c*, being stopped a short distance therefrom.

Moreover, handle 114 consists of two parts 119 and 120, which pivot about a pin 121, the pivoting being shown in detail in FIG. 7.

Part 119 forms the arm of handle 114, which is attached to binding 113; part 120 constitutes the end arm. The two arms are hinged substantially perpendicularly to edgings 114*a* and 114*b*. Near its free end, arm 119 has a right-angled set-back 119*a* having an upper wall (looking at ski-carrying element 101 as shown in FIGS. 5 and 6), beyond which it is thinner; in a complementary fashion, end arm 120 has at a lower part a right-angled set-back 120*a* beyond which it is also thinner. Pin 121 is located near internal edging 114*b*.

Element 101 is assembled in the same way as element 1 of the first embodiment. Thus, on the sole piece of ski 102 are placed, successively, plate 107, moving part 106, opening 113*a*, which receives pin 11, and stud 117 is placed in slot 118, for example, in such a way as to abut against terminal edging of slot 118 located on the side of edging 113*c*, which corresponds to the retracted position of handle 114, as shown in FIG. 5. In this case, arm 120 has, of course, been folded back around arm 119 in order to install moving part 116. Then, the cover is placed on plate 107 and fastened by means of the above-mentioned screws. The upper part of pin 111 and of stud 117 may also constitute fastening points between the cover and plate 107. In this retracted position, which is the operative position, the space occupied by arm 114 is smaller than that occupied by arm 14 of the first embodiment, which is the advantage of this second embodiment.

When the user wants to carry the skis by hand, all the user has to do is push back arm 120, for example, as indicated by arrow F' in FIG. 5, which causes moving part 106 to pivot and, at travel end, to bend arm 120 around pin 121 to reconstruct handle 114, so that it can now be used, as shown in FIG. 6. In this position, edging 113*e* of part 113 is in abutting engagement with set-back 115*a* of excessively thick area 115. In the same way, travel is limited by causing stud 117 to abut against the opposite edging of slot 118. Thus, to transport ski 102, since its heaviest part lies behind pin 111, abutment of edging 113*e* against wall 115*a* will result in good balance during transport.

When the user wants to ski, all he needs to do is fold back arm 120 toward arm 119 from the position shown in FIG. 6, then push this folded-back arm to bring it to the position shown in FIG. 5.

Figure 9:
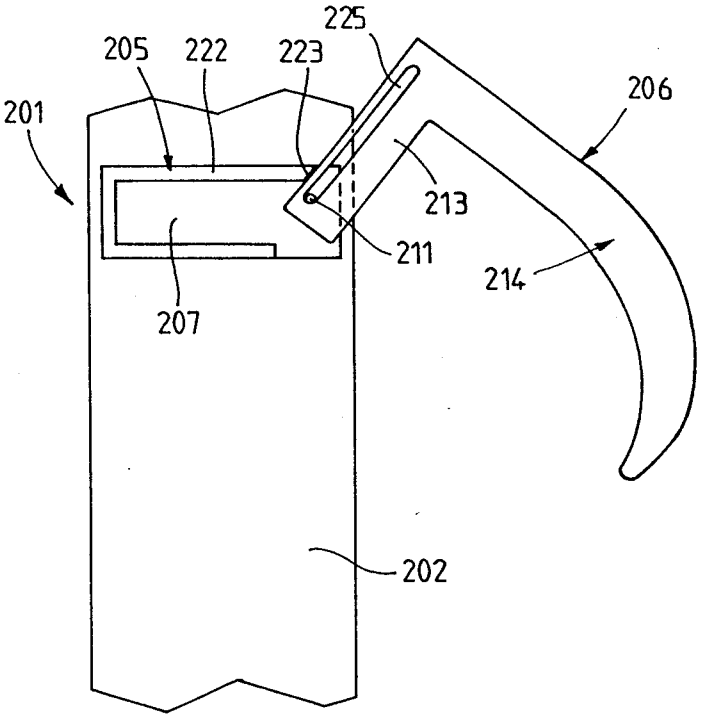
FIG. 9 is a view corresponding to FIG. 8, showing the ski-carrying element in this Figure in its operative position, the cover of the fixed part having been removed to show the whole plate from above.
Figure 8:
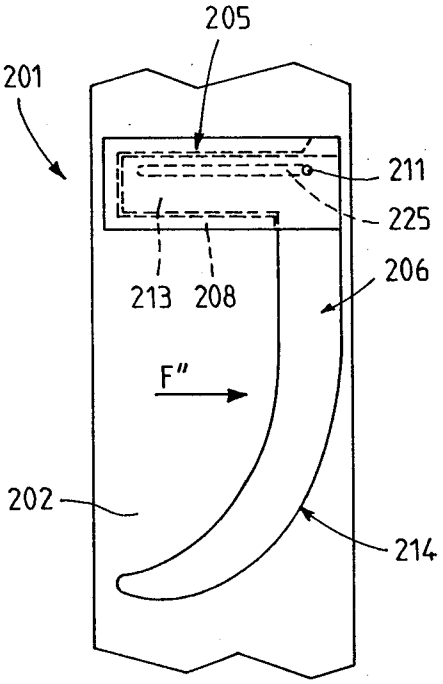
FIG. 8 is a partial top plan view of a ski seated on its sole piece and showing the area of the sole piece which is equipped with a ski-carrying element in accordance with the third embodiment of the invention described above, in the retracted position of the ski corresponding to the non-operative position.

FIGS. 8 and 9 show a ski-carrying element 201 in accordance with a third embodiment of the present invention. In the same way as before, the element 201 has a fixed part 205 and a moving part 206.

Fixed part 205 has a plate 207 in the shape of an elongated rectangle, and it is adapted to be installed transversely on ski 202 in the area lying between the two bindings. In other words, plate 207 is shorter than the width of the sole piece of ski 102.

The plate 207 has an edge 222 extending along one of its longitudinal sides, starting from the proximity of one of its ends, where it forms on the inside a sharp edge 223, the edge 222 continues along the adjacent transverse side, and then along the other longitudinal side to a distance from the opposite edge which is larger than sharp edge 223. This distance is slightly greater than the width of handle 214, as will be described hereinafter.

Also, plate 207 carries near sharp edge 223, but beyond edge 222, a pin 211, which is equivalent to pins 11 and 111 of the preceding embodiments.

Cover 20 (FIG. 9) consists of a plate having the same elongated rectangular shape, since it is designed to be pressed against edge 222, where it is fastened, for example, by screws which also fasten plate 207 onto ski 202. Plate 207 may also be secured directly to the sole piece of ski 202 by any means not shown in the drawing.

Moving part 206 consists of a handle 204 and an element 213 connecting the handle 214 to fixed part 205. The moving part 206 forms a flat piece which is thinner than the height of edge 222 measured internally.

Element 213 has the form of an elongated rectangular strip, which is shorter than the length of plate 207 by a distance equal to the thickness of edge 222 is also less wide than plate 207 measured inside edge 222. Along its edging opposite the area joining handle 214, it has a slot 225 parallel to the edging.

Handle 214 is joined at right angles to one end of binding 213; also, it has an end which is curved on the same side as binding 213.

Element 201 is assembled very simply by mounting plate 20, then moving part 206, the pin 211 being received in slot 225, for example, in the position shown in FIG. 8. Finally, cover 208 is put in place.

In order to use handle 214, it need only be pushed as indicated by arrow "F" in FIG. 8 until the opposite end of slot 225 abuts against pin 211, after which handle 214 is rotated on the pin 211, as shown in FIG. 9. Ski 202, whose part located behind pin 211 is the heaviest, is made to abut against sharp edge 223 to provide a balanced transport of ski 202.

The embodiment described with reference to FIGS. 8 and 9 has the advantage of being more impervious and easier to construct.

While particular embodiments of the invention have been shown, it will be understood that the invention is not limited thereto, since modifications may be made without departing from the scope of the invention. Thus, the handle of the first and third embodiments may consist of two parts, as is the case with the second embodiment. In the case of the first two embodiments, means may be provided to return the handle to its retracted position, which, for example, consist of a spring located on the level of the axis of articulation. Means may also be provided to return the end arm of the handle to its folded-back position, if this handle consists of two parts. Slot 225 provided in binding 213 of moving part 206 of the third embodiment may also be eliminated. In this case, the binding 213 has on its end part a stud which is able to circulate in a groove provided in fixed part 205. At the end of the disengagement stroke of element 213 perpendicularly to ski 202, the stud will be locked in a housing in order to form the axis of articulation in this housing. In the previous variant, provision may also be made that binding 213 does not have a slot 225 either, but has on its end opposite handle 214 a shape that is curved in the direction opposite to that of handle 214 still in the plane of moving part 206, so that at the end of the removal stroke of element 213 the rounded part receives sharp edge 223. The part 206 can rotate about the sharp edge 223 as the axis of rotation. A means also is provided to retain in translation moving part 206 in the pivoting position. Also, in the case of the third embodiment described above and of the two variants just mentioned, elastic devices may be provided to return moving part 206 to the position it occupies in FIG. 8.

I claim:

1. A ski-carrying element permitting substantially horizontal transportation of a ski by hand in a balanced fashion, said ski-carrying element comprising:

a fixed part including an abutment means and a plate mounted on a sole piece of the ski, said plate being mounted on said ski without extending therebeyond, said plate carrying said abutment means;

means for binding said ski-carrying equipment to said sole piece of the ski on a face of the ski which faces a bottom of a ski boot;

a moving part for gripping said ski-carrying element, said moving part being movable between an unfolded position, in which said moving part extends beyond one of the sides of the ski, and a retracted position in which said moving part is located between the sides of said ski, the moving part being mounted to pivot about an axis of rotation perpendicular to the sole piece of the ski, said moving part abutting against said abutment means of said fixed part in said unfolded position, said moving part including a binding element for binding to the fixed part, said binding element including a means for pivoting, sliding said moving part relative to said fixed part, said moving part including an operating handle for extending said binding element, said binding element of said moving part being slidably mounted on said plate in a direction perpendicular to a mid-line of the sole piece of the ski, on one side of said mid-line, between a position corresponding to the retracted position, where the binding element is prevented from rotation, and the unfolded position in which the binding element is then able only to pivot about the axis of rotation located in a corresponding terminal area of the binding element, the handle being connected to the binding element on a side opposite to the terminal area in which said pivoting occurs, wherein a greater weight of a part of the ski being located behind said ski-carrying element relative to said axis.

2. The ski-carrying element as set forth in claim 1, wherein the plate is protected by a cover, a space between said plate and said cover serving as a housing for said binding element of the moving part.

3. The ski-carrying element as set forth in claim 1, wherein the axis of rotation is carried by the plate and the binding element has a slot passed through by said means for pivoting to enable said binding element to slide.

4. The ski-carrying element as set forth in claim 1, wherein the abutment means carried by the fixed part for supporting the moving part in the unfolded position consists of a sharp edge of a vertical edge of the plate said verticle edge enabling a cover to be fastened.

5. A device to enable a pair of skis to be carried by hand, according to claim 1, wherein each ski of a pair of skis being providing with said ski-carrying element.

6. The ski-carrying element as set forth in claim 1, wherein the fixed part has a second abutment means for the moving part in the retracted position, in which said moving part does not go beyond the sole piece of the ski.

* * * * *